US005442422A

United States Patent [19]

Owens, Jr. et al.

[11] Patent Number: 5,442,422

[45] Date of Patent: Aug. 15, 1995

[54] TONER CONTAMINATION SEAL DEVICE FOR CLEANER

[75] Inventors: Alvin J. Owens, Jr., Fairport; Douglas J. Baxendell, Rochester, both of N.Y.

[73] Assignee: Xerox Corporation, Stamford, Conn.

[21] Appl. No.: 257,588

[22] Filed: Jun. 8, 1994

[51] Int. Cl.[6] ..... G03G 21/00

[52] U.S. Cl. ..... 355/215; 355/296; 355/298; 355/299; 355/301; 15/256.5; 118/652

[58] Field of Search ..... 355/296–299, 355/301, 302, 215; 118/652; 15/256.5, 256.51, 256.52

[56] References Cited

U.S. PATENT DOCUMENTS

| | | | |
|---|---|---|---|
| 4,400,082 | 8/1983 | Kiba | 355/299 |
| 4,640,608 | 2/1987 | Higaya et al. | 355/299 |
| 4,910,560 | 3/1990 | Kanada | 355/299 |
| 5,027,513 | 7/1991 | Allison, Jr. | 15/256.51 X |

FOREIGN PATENT DOCUMENTS

| | | | |
|---|---|---|---|
| 0123488 | 6/1987 | Japan | 355/215 |
| 0125385 | 6/1987 | Japan | 355/215 |
| 0068980 | 6/1991 | Japan | 355/296 |
| 0043373 | 2/1992 | Japan | 355/215 |
| 0116569 | 4/1992 | Japan | 355/215 |

*Primary Examiner*—Matthew S. Smith
*Attorney, Agent, or Firm*—L. Fair

[57] ABSTRACT

An apparatus for cleaning an imaging surface with a hybrid cleaner that includes the implementation of a contamination seal in the cleaner unit. The contamination seal captures falling accumulated toner from the blade edge and in the brush nip, due to gravitation, which contaminates the xerographic area when the cleaner blade and disturber brush are retracted from the imaging surface. The contamination seal rests along the length of the blade portion that extends from the blade holder. In this position, the contamination seal does not touch the imaging surface to cause scratches nor does it interfere with the blade's ability to clean the imaging surface. Implementation of the contamination seal contains toner emission within the cleaner from the blade edge and brush nip.

19 Claims, 3 Drawing Sheets

TONER CONTAMINATION SEAL DEVICE FOR CLEANER

BACKGROUND OF THE INVENTION

This invention relates generally to a cleaner apparatus, and more particularly concerns a toner contamination seal for a cleaner.

A single blade hybrid cleaner consists of a disturber brush and a doctor cleaning blade. Due to the unique cleaner configuration, as the brush and blade clean the imaging surface (e.g. photoreceptor or photoconductor), toner removed from the imaging surface accumulates at the cleaning edge of the blade and the brush nip. As a result, toner contamination of the xerographic area occurs when the cleaning edge of the blade is retracted from the imaging surface. The toner that has accumulated at the blade edge and brush nip, falls down the imaging surface length during retraction, contaminating charge devices, erase lamps, sensors and other xerographic devices. The toner contamination results in copy quality defects and decreased operating efficiency of various xerographic components. In order to achieve engineering reliability, service and customer satisfaction goals such toner contamination problems have to be eliminated.

The following disclosures may be relevant to various aspects of the present invention and may be briefly summarized as follows:

U.S. Pat. No. 4,910,560 to Kanada describes a cleaning device provided with a blade adapted to contact the peripheral surface of a photosensitive drum and wipe residual toner off of the photosensitive drum. A duct is disposed separately from the blade, and is adapted to remove the toner wiped off by the blade by air suction. In the interval between the blade and the duct, there is disposed a sealing member which serves to prevent ambient air from entering the duct through the interval. This sealing member is fixed either on a stationary region of a holder for the blade or on the basal end part of the blade integrated with the holder or on the outer surface of the duct, and contacts the duct if mounted on the holder or the blade, or contacts the blade or holder if mounted on the duct.

U.S. Pat. No. 4,640,608 to Higaya et al. describes a cleaning method which includes the cleaning blade being brought into pressure contact with the photoreceptor at least prior to the movement of the photoconductor, and moving the cleaning blade away from the surface of the photoconductor after the movement of the photoconductor is stopped with completion of the copying process. A stationary seal member allows uncleaned toner on the drum to pass therethrough but does not permit the toner removed by the cleaning blade to pass therethrough.

U.S. Pat. No. 4,400,082 to Kiba describes a cleaning apparatus for removing toner remaining on a moving photoconductive member which has a resilient blade in bearing contact with surface of the photoconductive member and reciprocatingly movable laterally of the direction of movement of the surface, a seal member provided at each end of the photoconductive member and having a width in the direction of the lateral movement of the blade equal to at least the range of lateral movement of the corresponding end of the blade, the seal member being disposed in contact with the rear seal member being disposed in contact with the rear surface of the blade in the range of lateral movement of the blade end. Toner particles are thereby prevented from falling from the blade off the end of the photoconductive member.

SUMMARY OF INVENTION

Briefly stated, and in accordance with one aspect of the present invention, there is provided an apparatus for cleaning particles from a surface. The apparatus comprises means for removing particles from the surface. The removing means moving between an operative position contacting the surface to remove particles therefrom and an inoperative position spaced from the surface. Means, moving from a position spaced from the surface to a position in contact therewith in response to the removing means moving from the operative position to the inoperative position, for capturing the particles released from the removing means as the removing means moves from the operative position to the inoperative position.

Pursuant to another aspect of the present invention, there is provided a method for preventing toner contamination of an imaging surface of a printing machine, comprising the step of accumulating toner on a blade and on a brush. The step of urging a contamination seal into contact with the imaging surface. The step of moving the blade away from contact with the imaging surface, causing the toner to fall from the blade toward a waste container. The step of moving the brush from contact with the imaging surface, causing the toner to fall from the brush toward a waste container. And capturing, in the seal, loose toner falling from the blade and the brush.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Reference is now made to the drawings where the showings are for the purpose of illustrating a preferred embodiment of the invention and not for limiting same.

Figure 1:
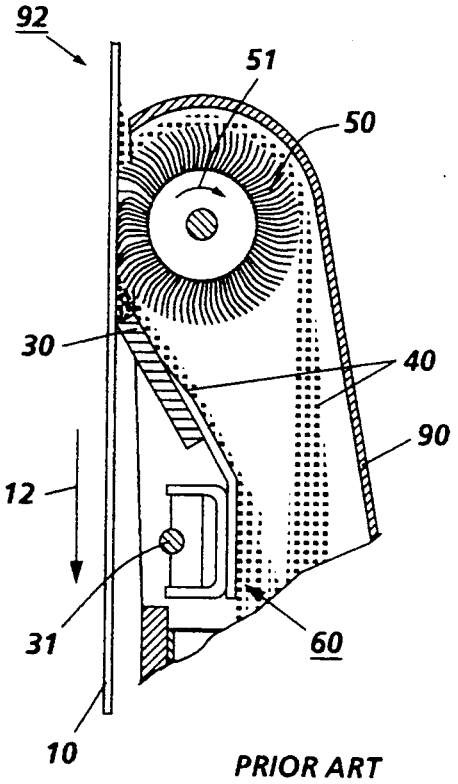
PRIOR ART FIG. 1
FIG. 1 shows a prior art, partial elevational view of a hybrid cleaner including a blade cleaner and a disturber brush.

Reference is now made to FIG. 1, which shows a prior art partial elevational view of a hybrid cleaner. The hybrid cleaner 92 includes a disturber brush 50 and a cleaning blade 30 that contact the photoreceptor 10. This hybrid cleaner 92 is partially enclosed in a housing 90. The disturber brush 50 is located upstream from the cleaning blade 30, in the direction of motion shown by arrow 12, of the photoreceptor belt 10. The disturber brush 50 mechanically cleans and loosens toner 40 from the imaging surface of the photoreceptor 10. The cleaning blade 30 is the primary cleaner and removes the toner and other debris particles loosened and/or left behind by the disturber brush 50 from the photoreceptor 10. The cleaning blade 30 is attached to a blade holder 60 on the blade edge not in contact with the photoreceptor 10. The cleaning blade 30 is shown in the doctoring mode. The disturber brush 50 rotates in a clockwise direction shown by arrow 51.

Figure 2:
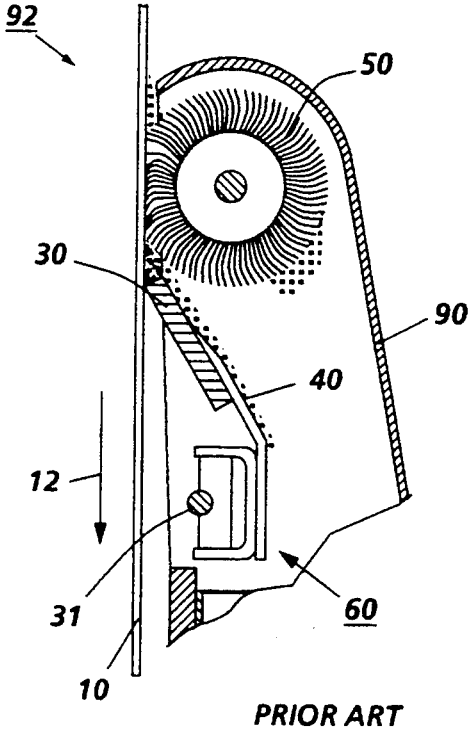
PRIOR ART FIG. 2
FIG. 2 shows the accumulation of toner at the cleaning edge of the blade and brush nip that occurs in the prior art configuration of FIG. 1.

Reference is now made to FIG. 2, which shows the build up of toner 40 at the brush nip and the blade cleaning edge in the prior art cleaner of FIG. 1. This build up of toner occurs due to the cleaner configuration. Especially when the cleaner 92 is in either a three o'clock or nine o'clock cleaning position, the toner 40 can easily build up on the "shelf" created by the edge of the blade 30, in the doctoring mode, and the brush nip. This "shelf" occurs at the blade edge that is in contact with the photoreceptor 10 and adjacent to the disturber brush 50. As the brush 50 and blade 30 clean the imaging surface 10, toner 40 removed from the imaging surface 10 accumulates at the cleaning edge of the blade 30 and the brush nip. In FIG. 2, the rotation of the disturber brush 50 is stopped prior to retraction of the cleaner unit 92 from the photoreceptor 10. The rotation of the brush 50 does not resume until the cleaning unit 92 is back in it's original position and the xerographic machine is back in operation.

Figure 3:
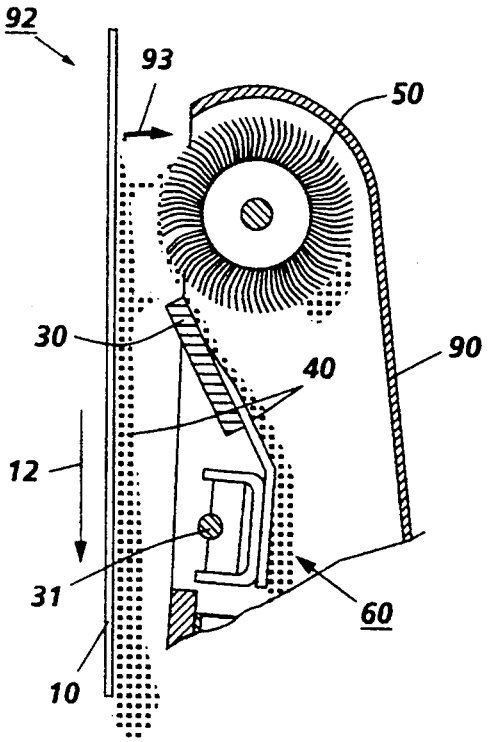
PRIOR ART FIG. 3
FIG. 3 shows that during retraction of the cleaner, the accumulated toner, shown in prior art of FIG. 2, falls down the length of the photoreceptor.

Reference is now made to the prior art of FIG. 3, which shows the accumulation of toner 40 at the blade edge, as shown in FIG. 2, falling down the length of the photoreceptor 10, during retraction of the cleaner blade 30 and the disturber brush 50. Toner contamination of the xerographic area results when the cleaning edge of the blade 30 is retracted from the imaging surface 10. The toner 40 that has accumulated at the blade edge falls down the imaging surface 10 length during retraction contaminating charge devices, erase lamps, sensors and other xerographic devices. The toner contamination results in copy quality defects and decreased operating efficiency of various xerographic components.

Figure 4:
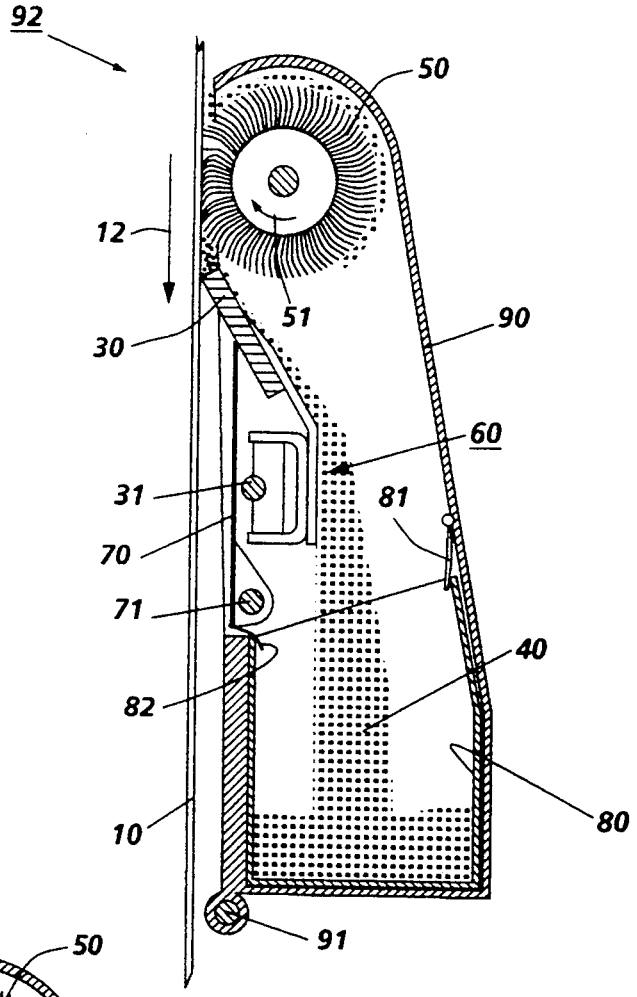
FIG. 4 shows an elevational view of the present invention of a seal in a hybrid cleaner.
Figure 5:
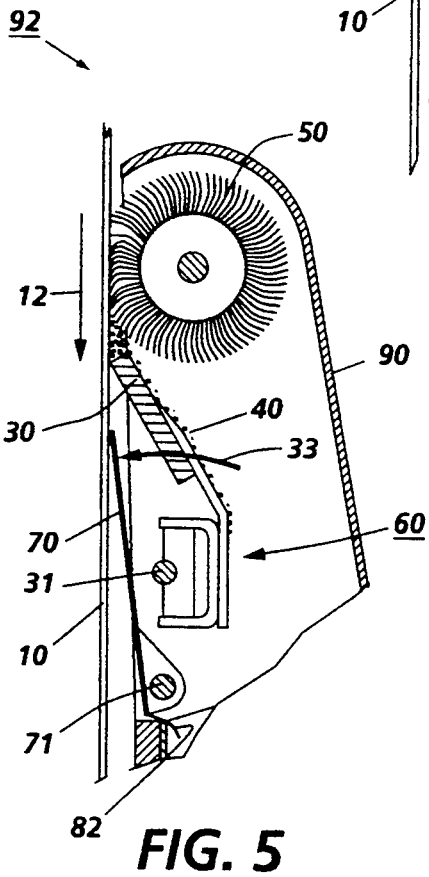
FIG. 5 shows a partial elevational view of the cleaner with the seal in contact with photoreceptor.

Reference is now made to FIG. 4 which shows an elevational view of the present invention of a contamination seal 70 in a hybrid cleaner. The purpose of the present invention, specifically in the 3 o'clock and 9 o'clock cleaning position, is to eliminate the toner contamination problem in the xerographic area. (The 3 o'clock and 9 o'clock cleaner positions provide the gravitational force needed to attract and guide the particles falling from the blade 30 and brush 50 toward a waste container.) The contamination seal 70 prevents the contamination of the xerographic area and components, allowing for a much cleaner copier or printer. The contamination seal 70 prevents copy quality defects related to toner emissions in the xerographic area and improves the operating efficiency, reliability and life of various xerographic components such as charge devices, erase lamps and sensors. Implementation of the contamination seal allows movement in the direction of achievement of reliability, service and customer satisfaction goals due to the containment of toner emission within the cleaner from the blade edge and brush nip. The contamination seal 70 is in the cleaner apparatus 92 to capture accumulated toner 40 at the blade edge and in the brush nip. The contamination seal 70 is retractable allowing the seal to move into tangential contact with the photoreceptor 10 (see FIGS. 5 and 6) and out of contact with the photoreceptor 10 (see FIGS. 7 and 8). The contamination seal 70 can be made from materials such as: polycarbonate, polyurethane, polyethylene, polypropylene, polyester thermoplastics (e.g. Mylar) or any other material with low resistance to set. The seal 70 is stiff enough to prevent toner from escaping pass the seal, when the seal is in contact with the photoreceptor.

With continued reference to FIG. 4, there are three pivot points in the present invention which allow movement of the seal 70, the cleaning blade 30, and the brush 50 and cleaning unit 92, in concert or independently, into and out of contact with the photoreceptor 10. The seal 70 is mounted pivotally in the cleaner apparatus 92 about a pivot point 71 and below the cleaning blade 30. The cleaning blade 30 is mounted to a blade holder 60, which is mounted pivotally about a pivot point 31 in the cleaner unit 92. The disturber brush 50 moves in concert with the cleaning unit 92 about a pivot point 91.

Continuing reference to FIG. 4, the seal 70 in it's original (i.e. home) position prevents toner 40 from falling onto the photoreceptor 10 during cleaning. The seal 70 prevents particles from dropping between the cleaning blade holder 60 and the waste toner bottle 80 onto the photoreceptor 10, as gravity pulls the falling toner particles 40 into the waste toner bottle 80. The flap seals 81, 82 or similar devices assist in guiding toner particles 40 and other debris into the waste toner bottle 80. These flap seals 81, 82 avoid toner contamination between the cleaner housing 90 and the waste bottle 80 and on the photoreceptor 10, respectively.

In the present invention, the technical service representative pulls out a xerographic drawer (not shown) from the printer machine after the machine has been shut off. The printer machine is shut off when it is necessary to retract the cleaner blade 30 for photoreceptor 10 removal, service calls, preventive maintenance (i.e. PM) or the trouble shooting of other subsystems. When this drawer is open, a handle or a similar mechanism for rotation is exposed that allows the technical service representative to cam the seal 70, about pivot 71, into contact with the photoreceptor 10 from it's original position (see FIG. 4) to the position of contact with the photoreceptor 10, shown in FIG. 5. The movement of the seal 70, shown by arrow 33, into contact with the photoreceptor 10 occurs after the printing machine has ceased operation and the brush 50 has stopped rotating. Positioning of the contamination seal 70 on the imaging surface 10 insures the capture of residual toner 40 during blade 30 retraction. Any number of mechanical devices may be used to cam and retract the contamination seal 70 (and/or the cleaning blade 30 and/or the brush 50 and the cleaner unit 92) to and from the imaging surface 10. (The handle/mechanism described above also cams in and retracts out the cleaning blade 30 and the brush 50 and cleaner unit 92 as it is rotated.)

Figure 6:
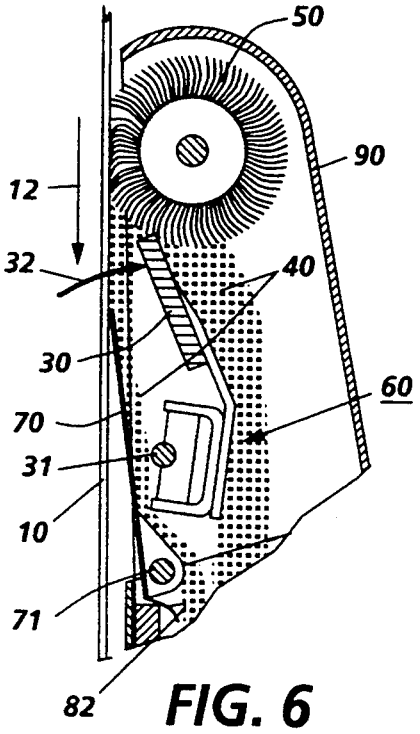
FIG. 6 shows a partial elevational view of the cleaner with the blade retracted from contact with the photoreceptor and the seal in contact with the photoreceptor.

The technical service representative continues rotation of the mechanism to move the blade 30, about pivot 31, away from the surface of the photoreceptor 10 as shown in FIG. 6. The movement of the retracting blade 30 from the imaging surface of the photoreceptor 10 is shown by arrow 32. As the blade 30 retracts from the imaging surface of the photoreceptor 10, the accumulated toner particles 40 at the blade edge and brush nip fall away from the blade edge and brush nip toward the waste container. The contamination seal 70, still in contact with the imaging surface, captures the falling toner and other residual particles that fall toward and onto the photoreceptor 10 and directs these particles to the waste container. The retraction of the brush 50 and cleaner unit 92 about pivot 91 (see FIG. 7) from the photoreceptor 10, while the contamination seal 70 is still in contact with the photoreceptor 10 is not shown. However, the seal 70 operates in the same manner as described above regarding toner falling from the blade edge, when accumulated toner 40 falls from the brush nip as it is moved away from the photoreceptor surface. The seal 70 insures the capture of loose particles 40 and guides the particles 40 to the waste container to prevent contamination of the imaging surface.

Figure 7:
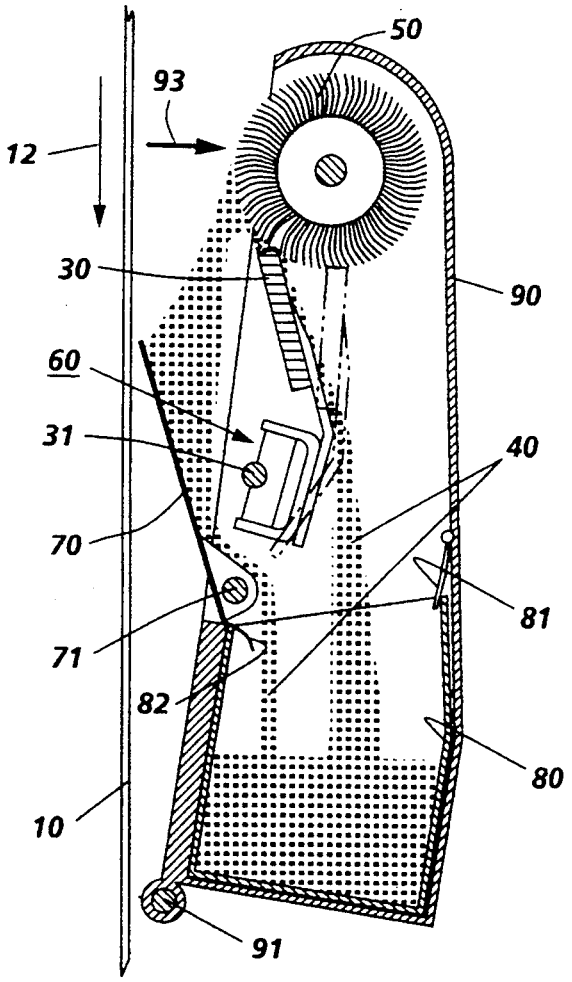
FIG. 7 shows retraction of the cleaner to move both the brush and seal from contact with the photoreceptor.

Continuing rotation of the camming mechanism, retracts the seal 70, the cleaner blade 30, and the brush 50 and cleaner unit 92 as shown in FIG. 7, further away from the photoreceptor 10. The entire cleaner unit 92 is retracted away from the photoreceptor 10 in the direction shown by arrow 93 about pivot 91. The movement of the cleaner unit 92, retracts the seal 70 away from contact with the imaging surface of the photoreceptor 10 to a prescribed position. The contamination seal 70 is moved away from contact with the surface of the photoreceptor, to assist in the flow and direction of the particles along the seal length to the waste container 80. The seal 70 is also moved away from contact with the photoreceptor 10 when removal and replacement of the photoreceptor 10 is necessary. The further retraction of the cleaning blade 30 away from the photoreceptor 10, as shown in phantom lines in FIG. 7, wipes the blade 30 against the brush fibers cleaning the blade edge of toner and other residual particles 40 that did not readily fall from the retracting blade edge due to gravitational force. The further retraction of the cleaner unit 92 also allows easy removal and replacement of the blade 30 and brush 50 when necessary. (The seal can be replaced at the time of blade replacement or when the CRU (customer replacement unit) housing is replaced for remanufacture.)

Figure 8:
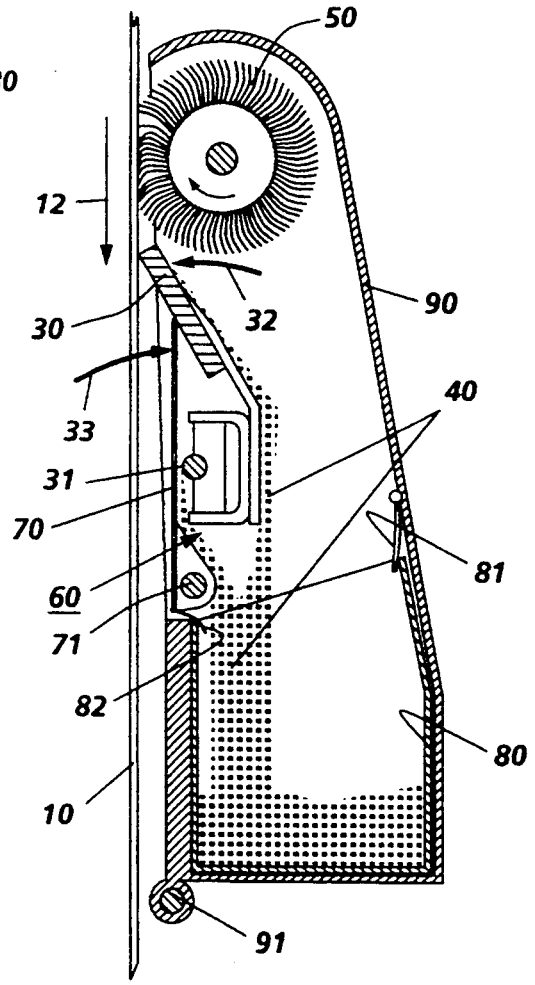
FIG. 8 shows the return of the blade, brush and seal to their original cleaner positions.

Completion of the cam rotation cycle returns the seal 70, blade 30 and brush 50 and cleaner unit 92 to their original positions, (after all necessary service and preventive maintenance activities have been completed), as shown by FIG. 8. The cleaning blade 30 and the brush 50 return to contact with the imaging surface of the photoreceptor 10. The seal 70 is located below the cleaning blade 30, away from contact with the imaging surface of the photoreceptor 10. Any residual toner 40 captured by the contamination seal 70 is urged toward the waste container 80 as the contamination seal 70 is returned to it's home position. The printer machine is now ready for operation again.

In recapitulation, the modified cleaner design consist of implementing a contamination seal in the hybrid cleaner configuration, located in a three or nine o'clock cleaning position, to capture accumulated toner from the blade edge and the brush nip that falls, due to gravitation, as the blade and brush are retracted form the imaging surface. The contamination seal prevents contamination of the xerographic area when the cleaner blade and disturber brush are retracted from the imaging surface. The contamination seal rests along the length of the cleaning blade that extends from the blade holder. In this position, the contamination seal does not touch the imaging surface to cause scratches nor does it interfere with the blade's ability to clean the imaging surface. Implementation of the contamination seal allows movement in the direction of achievement of reliability, service and customer satisfaction goals due to the containment of toner emission within the cleaner from the blade edge and brush nip.

It is, therefore, apparent that there has been provided in accordance with the present invention, a seal for a cleaning apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for cleaning particles from a surface, comprising:

means for removing particles from the surface, said removing means moving between an operative position contacting the surface to remove particles therefrom and an inoperative position spaced from the surface; and means, moving from a position spaced from the surface to a position in contact therewith in response to said removing means moving from the operative position to the inoperative position, for capturing particles released from said removing means as said removing means moves from the operative position to the inoperative position, said capturing means being in contact with the surface collecting particles escaping past said removing means when said removing means is in the operative position.

2. An apparatus as recited in claim 1, wherein said removing means is removable for replacement.

3. An apparatus as recited in claim 1, further comprising a waste container adapted to receive particles.

4. An apparatus as recited in claim 1, wherein said removing means for the surface, the surface having movement, comprises:

means for cleaning the surface; and means for disturbing the surface, located upstream from the cleaning means in a direction of motion of the surface.

5. An apparatus as recited in claim 4, wherein said disturbing means comprises a brush.

6. An apparatus as recited in claim 5, wherein said cleaning means comprises a blade.

7. An apparatus; as recited in claim 6, wherein said capturing means comprises a seal.

8. An apparatus as recited in claim 7, wherein said seal comprises a flexible sheet chosen from the group of materials consisting of polyester thermoplastics, polycarbonate, polyurethane, polyethylene, and polypropylene.

9. An apparatus as recited in claim 8, wherein said blade includes having a free blade end, said free blade end movable between the operative position having a first blade position, and the inoperative position having a second blade position and a third blade position.

10. An apparatus as recited in claim 9, wherein said free blade end contacts the surface in the first blade position.

11. An apparatus as recited in claim 10, wherein said free blade end is spaced from the surface and said brush in the second blade position.

12. An apparatus for cleaning particles from a surface, comprising:

means for removing particles from the surface, said removing means moving between an operative position contacting the surface to remove particles therefrom and an inoperative position spaced from the surface, said removing means comprising a blade for cleaning the surface and a brush for disturbing the surface, said brush located upstream from said blade, said blade having a free blade end movable between the operative position, having a first blade position with said free blade end contacting the surface, and the inoperative position having a second blade position with said free blade end spaced from the surface and said brush and a third blade position, said free blade end is spaced from the surface contacting said brush in the third blade position, with said brush removing particles from said free blade end, as said free blade end moves from the second blade position to the third blade position; and a seal, moving from a position spaced from the surface to a position in contact therewith in response to said removing means moving from the operative position to the inoperative position, for capturing particles released from said removing means as said removing means moves from the operative position to the inoperative position, said seal comprises a flexible sheet chosen from the group of materials consisting of polyester thermoplastics, polycarbonate, polyurethane, polyethylene, and polypropylene.

13. An apparatus as recited in claim 12, wherein the particles are captured by said seal and directed therealong into said waste container.

14. A method of preventing toner contamination of an imaging surface of a printing machine, comprising the steps of:

accumulating toner on a blade and on a brush;

urging a contamination seal into contact with the imaging surface;

collecting, in the seal, toner escaping past the blade;

moving the blade away from contact with the imaging surface causing the toner to fall away from the blade toward a waste container;

moving the brush from contact with the imaging surface causing the toner to fall away from the brush toward the waste container; and capturing, in the seal, loose toner falling from the blade and the brush.

15. A method as recited in claim 14, further comprising the step of stopping the printing machine.

16. A method of preventing toner contamination of an imaging surface of a printing machine, comprising the steps of:

accumulating toner on a blade and on a brush;

urging a contamination seal into contact with the imaging surface;

moving the blade away from contact with the imaging surface causing the toner to fall away from the blade toward a waste container;

moving the brush from contact with the imaging surface causing the toner to fall away from tile brush toward the waste container;

capturing, in the seal, loose toner falling from the blade and the brush;

stopping the printing machine;

removing toner from the blade by wiping a free edge against the brush as the blade moves away from the imaging surface, past the brush, with toner falling on the seal; and guiding the toner along the seal into the waste container.

17. A method as recited in claim 16, further comprising the steps of:

moving the seal away from contact with the imaging surface;

returning the cleaning blade into contact with the imaging surface;

returning the brush into contact with the imaging surface; and restarting the printing machine.

18. A method as recited in claim 16, further comprising the steps of:

removing the brush; and replacing the removed brush.

19. A method of preventing toner contamination of an imaging surface of a printing machine, comprising the steps of:

accumulating toner on a blade and on a brush;

urging a contamination seal into contact with the imaging surface;

moving the blade away from contact with the imaging surface causing the toner to fall away from the blade toward a waste container;

moving the brush from contact with the imaging surface causing the toner to fall away from the brush toward the waste container;

capturing, in the seal, loose toner falling from the blade and the brush;

stopping the printing machine;

removing toner from the blade by wiping a free edge against the brush as the blade moves away from the imaging surface, past the brush, with toner falling on the seal;

guiding the toner along the seal into the waste container;

moving the seal away from contact with the imaging surface;

returning the cleaning blade into contact with the imaging surface;

returning the brush into contact with the imaging surface; and restarting the printing machine;

removing the blade; and replacing the removed blade.

* * * * *